United States Patent [19]

Tallard

[11] Patent Number: 4,543,016

[45] Date of Patent: Sep. 24, 1985

[54] UNDERGROUND LEACHATE BARRIER AND METHOD OF MAKING SAME

[76] Inventor: Gilbert R. Tallard, 128 Corlies Ave., Pelham, N.Y. 10803

[21] Appl. No.: 551,463

[22] Filed: Nov. 14, 1983

[51] Int. Cl.[4] ..... E02D 5/18

[52] U.S. Cl. ..... 405/267; 405/129; 405/52

[58] Field of Search ..... 405/128, 129, 36, 267, 405/52, 53

[56] References Cited

U.S. PATENT DOCUMENTS

| | | | |
|---|---|---|---|
| 373,946 | 11/1887 | Richardson | 52/169.5 |
| 2,978,779 | 4/1961 | Tatsch | 52/169.5 X |
| 3,625,010 | 12/1971 | Hakundy | 405/38 |
| 3,736,754 | 6/1973 | Azalbert et al. | 405/53 |
| 3,759,044 | 9/1973 | Caron et al. | 405/267 |
| 3,851,478 | 12/1974 | Ayers | 405/267 |
| 4,142,344 | 3/1979 | Palmaer | 52/169.5 X |
| 4,352,601 | 10/1982 | Valiga et al. | 405/128 X |
| 4,448,690 | 5/1984 | Maphis | 405/128 X |

*Primary Examiner*—Dennis L. Taylor

[57] ABSTRACT

The invention comprises a method for making an underground barrier for hazardous leachate that includes digging a trench under biodegradable slurry adjacent a contaminated area, placing a liquid impervious membrane on one side of the trench and securing it by an impervious plug of material lining the bottom of the trench adjacent the membrane's lower end. A drain pipe and risers are positioned in the slurry into which filter gravel is subsequently added.

13 Claims, 6 Drawing Figures

UNDERGROUND LEACHATE BARRIER AND METHOD OF MAKING SAME

BACKGROUND OF THE INVENTION

This invention relates to subterranean barriers and more specifically to an underground barrier to prevent leachate from escaping a contaminated disposal area and to collect the leachate for above ground disposal.

PRIOR ART AND OBJECTS

Applicant is unaware of any subterranean barrier for containing hazardous leachates which includes a trench excavated under biodegradable slurry adjacent a contaminated site and contains a liquid impervious membrane placed along a wall of the trench which is sealed along the length of its lower edge by an impervious plug formed on the bottom of the trench. A drain pipe with monitoring risers is positioned in the slurry after which the trench and slurry are backfilled with filter gravel. The resultant novel barrier not only stops possible migration of the leachate out of the boundaries of the site but enables leachate entering the porous filter gravel and fermented biodegradable slurry mixtures to be collected in the drain pipe and pumped out through a riser pipe or at a low point pumping station for safe aboveground treatment and disposal.

Previous attempts to construct barriers for the subject purpose have taken the form of a combination of a vertically-extending, impervious barrier at the boundaries of the site to avoid propagation of the leachate, or source of underground contamination, into adjacent areas and a separate well or drainage trench or both for collection and removal of the leachate. Considering the cost of excavating two trenches, one deep for the impervious barrier and a shallower one for the drain, both possibly under hazardous conditions for workmen operating below ground surface, the present invention in contrast provides a novel solution by building both the impervious barrier and the drain in the same trench allowing the workmen free to work only above ground. In addition, when the excavated material is classified as hazardous it must be hauled away and disposed of in an approved site, and, all water pumped from the ground for dewatering the excavation must be treated prior to discharging, both conditions which are dangerous and expensive. The aforementioned disadvantages of the prior art methods are eliminated by combining installation of the impervious membrane with the installation of a drain collection system in the same narrow trench excavated under slurry. Thus, the invention eliminates the previous requirement of dewatering and required treatment of the pumped water, and the necessity for manual work by men below ground surface.

It is therefore the primary object of the present invention to provide a superior barrier to the migration of leachate from contaminated underground sites and the method of making such a barrier.

It is another object of the present invention to provide a barrier in a trench that can be excavated by workmen above ground by digging under a biodegradable slurry, thereby minimizing their exposure to hazardous contaminants and also minimize the volume of excavated material which must be hauled away and disposed of in an approved site.

It is yet another object of the present invention to provide a barrier which includes a membrane or liner of synthetic material impervious to the passage of liquid and a novel plug which anchors and seals the lower edge thereof.

It is a further object of the present invention to provide a barrier having drain and riser pipe means for monitoring and removing collected leachate which enters the barrier.

It is a still further object of the present invention to provide a barrier of the subject type which is extremely efficient in its operation and relatively inexpensive to construct and maintain.

Other objects and advantages of the present invention will become apparent and obvious from a study of the following description and accompanying drawings which are merely illustrative of the present invention.

DETAILED DESCRIPTION OF THE PREFERRED EMBODIMENT

Figure 1:
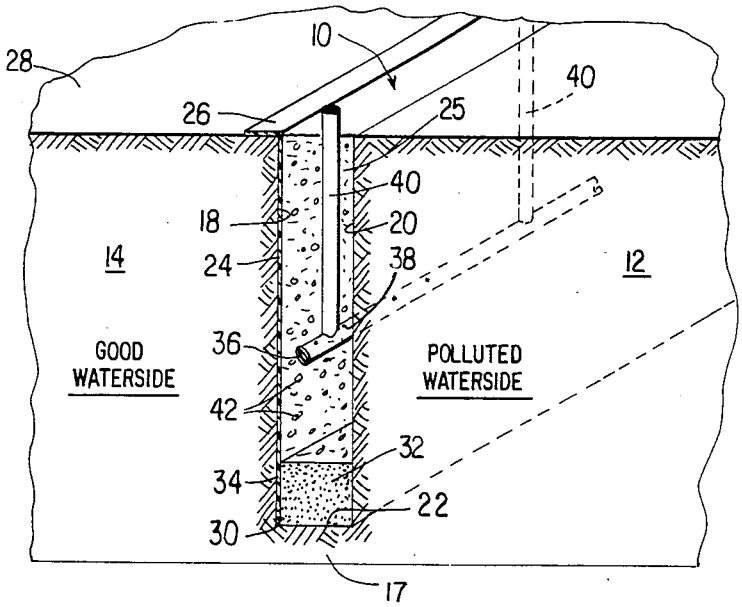
FIG. 1 is a pictoral view in partial cross-section of the barrier of the present invention positioned adjacent an area containing contaminated water.
Figure 2:
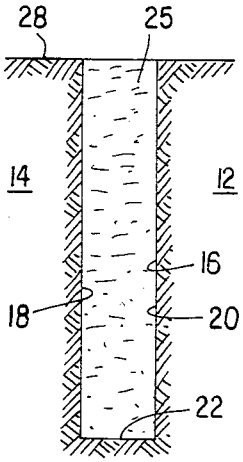
FIGS. 2–6 disclose the steps in making the barrier of the present invention.

Referring now to the drawings where like numerals refer to like elements in each of the several figures, 10 indicates generally in FIG. 1 the subterranean barrier constructed in accordance with the principals of the present invention.

The barrier 10 has as its primary function the containment of contaminated water or leachate within an area or site 12 labeled as the "polluted waterside" and prevent it from migrating out of the area 12 into an area or site 14 labeled as the "good waterside". The barrier 10 is located in a trench 16 having substantially vertical and parallel, spaced-apart side walls 18, 20 connected by a bottom 22. The trench 16 is excavated, by a method to be more fully described later, around or along the contaminated area 12. It being sufficient to state at this point that the trench 16 is dug to a depth where an impervious stratum or acuaclude 17 exists and is filled with a biodegradable slurry 25. The barrier 10 includes a vertical impervious membrane, sheet or liner of synthetic material 24 having a top edge 26 extending from a position on the top 28 of the ground 14 adjacent the side wall 18 of the "good waterside" to a lower edge 30. The lower edge 30 is slightly spaced from the bottom 22 of the trench 16. Pelletized bentonite, expansive clay or resin emulsion is backfilled into the trench 16 through the slurry 25 onto the bottom 22 to form a plug 32 adjacent the bottom 22. The plug 32 envelopes a portion 34 of the lower edge 30 along its length to thereby form a seal to prevent leachate from escaping around the lower edge 30 and into the area 14.

The lower 10 would, in one form, have a drain pipe 36 having drain holes or slots 38 and extending lengthwise in the trench 16 spaced a distance from the bottom 22 with riser or monitoring well pipes 40 secured thereto. The riser pipes 40 extend vertically to a position above ground to thereby enable the leachate level to be monitored or that collected drawn off and disposed of. The drain pipe 36 and risers 40 can be made of synthetic materials such as polyvinyl chloride or the like, compatible chemically with the leachate.

To complete the barrier 10, pervious filter gravel 42, or other manmade material similar thereto, is backfilled into the trench 16 where it is mixed with the biodegradable slurry 25. However, as the slurry component ferments, the impervious characteristic of the cake against the walls of the trench 18 & 20 disappears allowing outside fluids to enter, and the degraded slurry to flow inside the drain pipe and the drain 36 becomes operational. The membrane 24 will prevent any leachate not drawn off from entering the "good waterside" 14. In another form, the drain pipe 36 and riser pipes 40 can be eliminated if only a single barrier is desired with no capability of removing or monitoring the leachate from the polluted area 12. In this case, the granular mix which is backfilled into the slurry 25 is impervious in nature.

An example of a biodegradable slurry which applicant has formulated and found to be particularly effective is as follows:

| | | | |
|---|---|---|---|
| 1 | Biopolymer | 2 Kg | |
| 2 | Cross link | .5 Kg | (optional, as biopolymer booster) |
| 3 | Pregelatinized Starch | 30 Kg | |
| 4 | Bentonite | 10 Kg | |
| 5 | Bactericide | additive | (optional, if required) |
| 6 | pH regulator | additive | (optional, if required) |
| 7 | Water | 1,000 Kg | |

It should be noted that all proportions aforementioned can vary relatively to suit specific requirements technical and/or economic.

The following table is an example of possible combinations of the aforelisted components:

| | 1 Biopolymer | 2 Cross-Link | 3 Starch | 4 Bentonite | 7 Water |
|---|---|---|---|---|---|
| (I) | x | x | x | x | x |
| (II) | x | — | x | x | x |
| (III) | x | — | — | x | x |
| (IV) | x | x | — | x | x |
| (V) | — | — | x | x | x |
| (VI) | x | x | x | — | x |
| (VII) | x | — | x | — | x |

Figure 3:
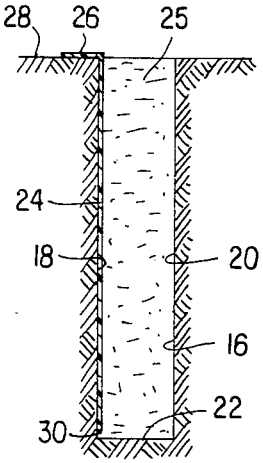
Figure 4:
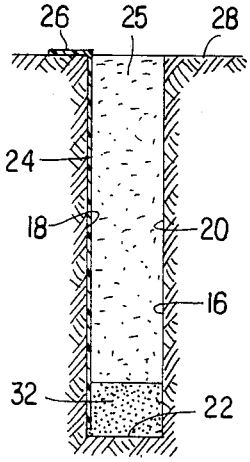
Figure 5:
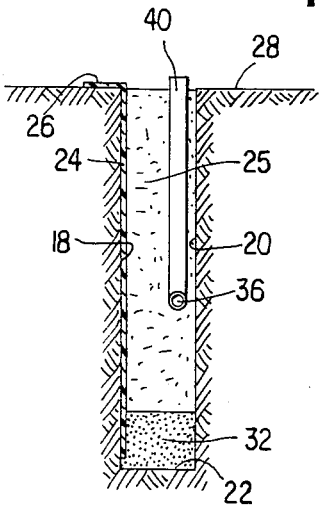
Figure 6:
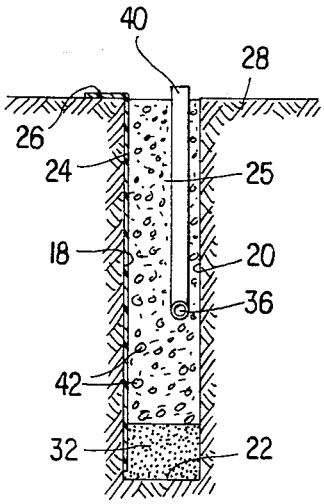

The method by which the barrier 10 is formed can best be seen by referring now to FIGS. 2–6. The first step shown in FIG. 2 comprises the excavation of the trench 16 at the boundary of the "polluted waterside" 12. This excavation can be done by conventional trenching machines with the actual digging being done under the biodegradable slurry 25 to a depth where an impervious stratum or acuaclude 17 exists. A liner 24 of synthetic material is next installed in the slurry 25 adjacent the side of the trench 18 opposite the side 20 next to the "polluted waterside" 12 as shown in FIG. 3. The liner extends downward to a point near the bottom 22 of the trench 16. Next, a resin emulsion, pelletized bentonite, expansive clay or the like is poured through the slurry 25 to the bottom 22 of the trench 16 to form the plug 32 as shown in FIG. 4. The plug material surrounds a portion 34 of the liner 24 and seals and anchors it in the slurry 25 at the bottom of the trench. The next step, the installation of a drain pipe 36 and riser pipes 40 in the slurry 25 as shown in FIG. 5 is optional depending on whether it is desired to remove the leachate collected. In the final step shown in FIG. 6, gravel 42 is backfilled into the slurry 25. If a drain pipe and riser pipes 40 were previously installed as shown in FIG. 5, the gravel 42 used would be pervious in nature. If no drain was installed, the gravel 42 used could be impervious in nature, and, together with the liner 24 and plug 32, form a totally impervious barrier to the migration of leachate from area 12 to area 14. If leachate collection becomes the sole purpose of the trench as may be the case for cross lot collection drainage within the boundary of the contaminated site, then the impervious membrane 24 and impervious plug 32 are omitted from the process. By extension this invention becomes a method for installing a deep drain pipe in the ground.

Applicant has thus described his novel barrier and the steps employed in constructing it. These and many different embodiments of this invention may be made without departing from the scope and spirit thereof. Therefore, it is to be understood that the invention is not limited to the specific embodiment shown and described herein, except as defined in the appended claims.

What I claim is:

1. A barrier for preventing underground leachate from flowing across a trench dug adjacent a contaminated area comprising:

(a) a trench extending from ground surface to a fluid impervious stratum, (b) membrane means of fluid impervious material in said trench having an upper end adjacent the top of said trench and extending to a lower end adjacent the bottom of said trench, (c) plug means extending along said bottom of said trench in fluid sealing engagement with said lower end of said membrane means and said fluid impervious stratum, and (d) filter means extending from said plug means to said top of said trench.

2. A barrier as set forth in claim 1 further comprising drain means in said filter means for removing said leachate from said trench.

3. A barrier as set forth in claim 2 wherein said drain means comprises a drain pipe extending in said trench, intermediate said top of said trench and said plug means, and riser means connected to said drain pipe extending to the top of said trench for monitoring and removing leachate collected in said drain pipe.

4. A barrier as set forth in claim 1 wherein said membrane means is a sheet of synthetic material.

5. A barrier as set forth in claim 1 wherein said filter means comprises a gravel-type material.

6. A barrier as set forth in claim 1 wherein said membrane means is located adjacent the side of said trench opposite said contaminated area.

7. A method of constructing a barrier for preventing underground leachate from flowing out of a contaminated area comprising the steps of:

(a) digging a trench adjacent said contaminated area from the ground surface to a depth sufficient to reach a fluid impervious stratum, (b) filling said trench with a slurry during digging to support the sides of the trench during digging, (c) lining a side of said trench with a fluid impervious membrane means, and (d) providing plug means along the bottom of said trench in fluid sealing engagement with said membrane means and said fluid impervious stratum.

8. The method according to claim 7 further comprising the steps of:

(a) installing a drain pipe in said slurry having risers to remove leachate collected in said drain pipe, and (b) adding filter gravel to said slurry.

9. The method according to claim 7 wherein said membrane means is a sheet of synthetic material.

10. The method according to claim 7 wherein said membrane means is located adjacent the side of said trench opposite said contaminated area.

11. The method according to claim 7 wherein said slurry is biodegradable.

12. The method according to claim 7 wherein said slurry is biodegradable and comprises a mixture which includes at least a biopolymer, starch, bentonite and water.

13. A barrier for preventing underground leachate from flowing across a trench dug adjacent a contaminated area comprising:

(a) a trench extending from ground surface to a fluid impervious stratum, (b) membrane means of fluid impervious material in said trench having an upper end adjacent the top of said trench and extending to a lower end adjacent the bottom of said trench, and (c) plug means extending along said bottom of said trench in fluid sealing engagement with said lower end of said membrane means and said fluid impervious stratum.

* * * * *